United States Patent [19]

Ortiz

[11] 3,939,909

[45] Feb. 24, 1976

[54] SYSTEM OF SUPPRESSING THE DISCHARGE CASING STRING IN DEEP-WELL VERTICAL PUMPS

[76] Inventor: Carlos Mayer Ortiz, Blas Pascal 135-1002, Mexico City 10, Mexico

[22] Filed: Feb. 4, 1974

[21] Appl. No.: 439,041

[30] Foreign Application Priority Data

Feb. 16, 1973 Mexico ..... 141636

[52] U.S. Cl. ..... 166/68.5; 166/106; 166/202

[51] Int. Cl.[2] ..... F04B 47/02

[58] Field of Search ..... 166/68.5, 68, 127, 191, 166/106

[56] References Cited

UNITED STATES PATENTS

| | | | |
|---|---|---|---|
| 591,382 | 10/1897 | Chapman | 166/106 |
| 2,205,421 | 6/1940 | Layne | 166/68.5 |
| 2,242,166 | 5/1941 | Bennett | 166/106 |
| 2,800,085 | 7/1957 | Hansen | 166/68.5 |
| 3,721,296 | 3/1973 | Tubbs | 166/106 |

*Primary Examiner*—Ernest R. Purser

*Attorney, Agent, or Firm*—O'Brien & Marks

[57] ABSTRACT

A system is disclosed, suitable to suppress the discharge pipe string in a deep-well vertical pump. In said system, a top seal is provided located at the top end of the well to hermetically seal the well's wall and form a duct towards the discharge mouth of said well; another seal being located in a cooperative relationship to the upmost impellent device and to the inner wall of the well, in order to allow for the well's wall portion comprised between said both seals to operate as the discharge tubing; said seal being proportional to the fluid pressure inside said wall portion.

3 Claims, 4 Drawing Figures

SYSTEM OF SUPPRESSING THE DISCHARGE CASING STRING IN DEEP-WELL VERTICAL PUMPS

BACKGROUND OF THE INVENTION

1. Field of the Invention

This invention relates to deep-well vertical pumps. More particularly, relates to a system suitable to replace the discharge pipe string of a pump of said type, with the wall itself of said well.

2. The Prior Art

In general, there are presently three different types of deep-well pumps: those employing water for lubricating purposes, those lubricated by oil and those with underwater electric motor. Although certain substantial differences are present in the string or strings inside the well, coming from the wellhead into the aspirating end thereof, all said three types of pumps are coincident in the provision of a pipe string for conducting the fluid to be pumped from said well, e.g., water.

As it is well known in the art, a substantial portion of the pump costs is caused by the discharge pipe string, since said pipe must be formed from tubing the manufacture of which is subjected to high-precision standards as it is well known in the art. Since a drawn tube of the current type cannot be employed for these purposes, as the same serves both as a duct for the passing of the fluid towards the wellhead, and as an aligning means for the lower end of the string as well as for centering and connecting the sheath inside which there is the shaft and the bearing-supporting means, the tubing from which said discharge pipe string is made should be a very special one. Further, said string serves also as a conducting and supporting means, or simply for connecting and centering the shaft, when associated with a oil-lubricated pump, a water-lubricated pump or an underwater electric motor pump. Therefore, it should be highly desirable for a system to eliminate or suppress said discharge pipe string from said pumps.

SUMMARY OF THE INVENTION

This invention provides for the suppression of said discharge pipe string. Accordingly, it is the main object of this invention to provide a system wherein a deep-well pump can be employed without a discharge pipe string, without sacrificing the efficiency thereof.

It is another object of this invention to provide a string for deep-well from which the discharge pipe string has been suppressed.

A further object of this invention is to provide a deep-well pump, capable of working without the discharge pipe string, in an efficient manner, as those pumps presently employed.

BRIEF DESCRIPTION OF DRAWINGS

The above and other further objects will become clearer upon examination of the following disclosure, together with the drawings accompanying hereof, wherein.

DESCRIPTION OF THE PREFERRED EMBODIMENTS

Figure 1:
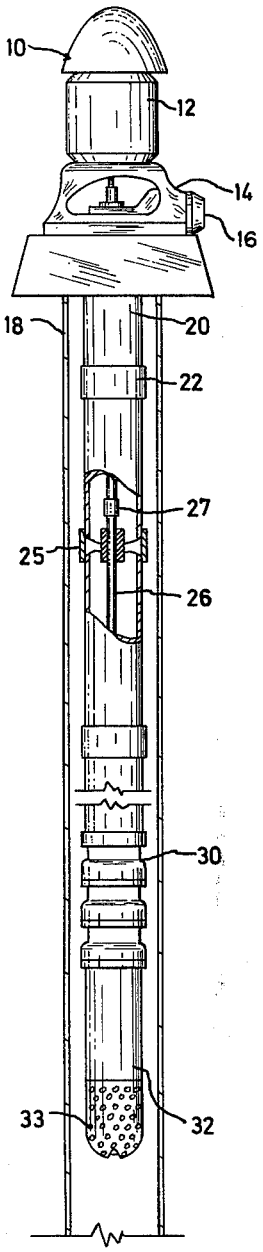
FIG. 1 PRIOR ART
FIG. 1 is a partially diagrammatical and partially sectional view of a water-lubricated deep-well pump, of the prior art as employed presently.

FIG. 1 shows a water-lubricated pump. This pump, as generally referred to by numeral 10, is formed by a motor 12, located exteriorly to said well, on a wellhead 14 wherein there is also the discharge mouth 16. From said wellhead covering the wellhole 18, a string extends downwardly and is formed by pipe lengths specially built, forming a discharge tubing 20. Said pipe lengths of said discharge tubing 20 are connected to each other by means of couples 22. Said couples 22, in a preferred embodiment, form at the same time bearing holders 25, serving for aligning and to rotatively support a shaft 26. Said shaft 26 is formed by shaft portions 27, connected to one another by means of couples, in order to obtain the required depth.

Said constitution of the tubing inside said well 18 continues as deep as necessary inside said well, and ends with a plurality of impelling bowls 30, serially arranged near the lower end of the string. Said string continues beyond said bowls 30 into a suction end 32, provided with a strainer 33.

Therefor, the fluid to be extracted from the bottom of the well, e.g. water, enters through the strainer 33 towards the suction end 32, due to the action of said impelling bowls. These latter are moved, in turn, by the shaft rotation carrying said bowls and communicating thereto the motor power and in such a way, that water enters the discharge pipe string inside which goes upwardly until the discharge mouth 16 is reached and, at the same time, said water lubricates the shaft 26 connection with said bearings 25 inside said string 20.

Figure 2:
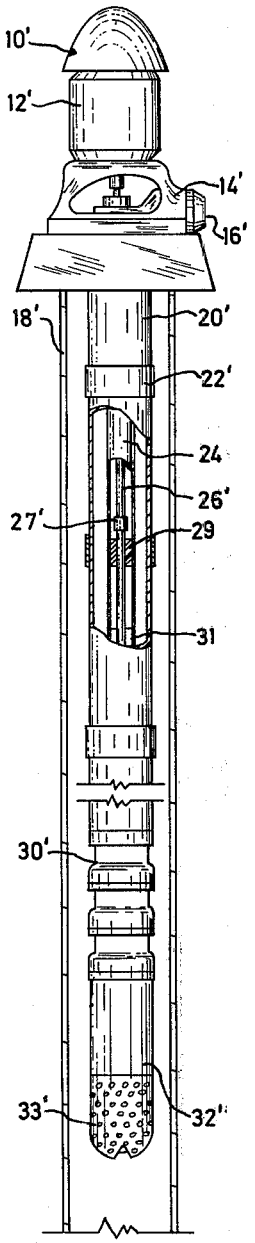
FIG. 2 PRIOR ART
FIG. 2 is a similar view to FIG. 1, of an oil-lubricated deep-well pump of the type presently in use.

On the other side, FIG. 2 shows an oil-lubricated pump, of a more complicated constitution. Similar numerals, with a "prime" suffix are employed in this FIG., relating to FIG. 1, for all corresponding parts. Thus, said pump 10' is constituted by a motor 12' located outside the well, on a wellhead 14' wherein there is also a discharge mouth 16'. Downwardly from the wellhead covering the wellhole 18', extends a string formed by pipe lengths specially built to form a discharge tubing 20'. Said tubing lengths of said discharge tubing 20' are connected to one another by couples 22' which, in the preferred embodiment, constitute the only connection between said lengths.

Located within said discharge tubing 20' there is also a shaft 26' constituted by lengths connected by shaft couplings 27'; however, said shaft, in turn, is exteriorly covered by a shaft sheath 24, formed by tubular elements connected to one another similarly to said discharge pipe string 20; the couplings 29 thereof also having bearings 31, generally made of bronze.

Said string inside said well 18' runs downwardly as deeply as required, ending in a plurality of impelling bowls 30', serially arranged near the lower end of said string; this latter projecting beyond said bowls 30', until a suction end 32'.

Thus, the fluid to be extracted from the bottom of the well, e.g. water, enters through the suction end 32' due to the action of said impelling bowls which, in turn, are moved by the shaft rotation transmitting to said bowls the motor power and, therefore, water passes into said discharge pipe string 20', going up thereinto to the discharge mouth 16' without contacting said shaft 26' or the bearings 31 protected by said sheath 24.

Figure 3:
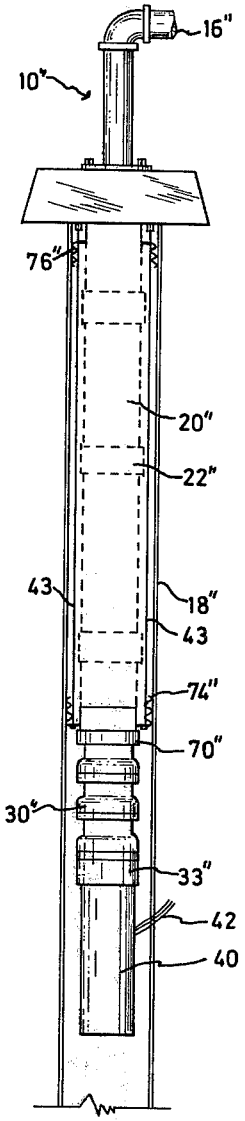
FIG. 3 is a similar view to FIGS. 1 and 2, of an underwater electric motor deep-well pump showing the parts forming said pump.

FIG. 3 shows a deep-well pump of the underwater electric motor type. In this Figure, all similar parts to those shown in FIGS. 1 and 2, are identified with same numeral, followed by "double prime" designation. So, pump 10'' is constituted by a discharge pipe string or tubing 20, surrounded by wall 18''; said tubing 20'' being constituted by a pipe string formed by short lengths connected to one another by couplings 22''. In FIG. 3, said discharge pipe string 22'' is shown in dotted lines, since according to the teachings of this invention when applied to this type of pump, said discharge pipe string can be eliminated.

Said underwater electric motor pump comprises also a pumping body formed by bowls 30'' connected to said discharge tubing 20'' by means of the lower end of said discharge tubing; beyond the lowermost bowl there is a suction end provided with a strainer 33'' avoiding the sorption or pumping of foreign matters; and finally, at the lowermost end thereof, there is an electric motor 40, connected to an outer power source through terminals 42. As can be appreciated from FIG. 3, said type of pump does not require a shaft 26 or any other element such as the bearing carrying couplings along the entire length of said discharge tubing but as in all of the embodiments shown in FIGS. 1 and 2, this pump is capable of having applied the principles of this invention, as will be clearly pointed out hereinbelow.

As appears from the above recited embodiments, a special duct must be provided for water or other fluid impelled by said bowls upwardly, can reach the discharge mouth, as otherwise water would reach the top edge of the uppermost bowl and, thence will fall again to the bottom of the well, without reaching the earth surface. Therefore, as shown in FIGS. 3 and 4, this invention provides for water conduction to the earth surface, without employing a discharge tubing.

Figure 4:
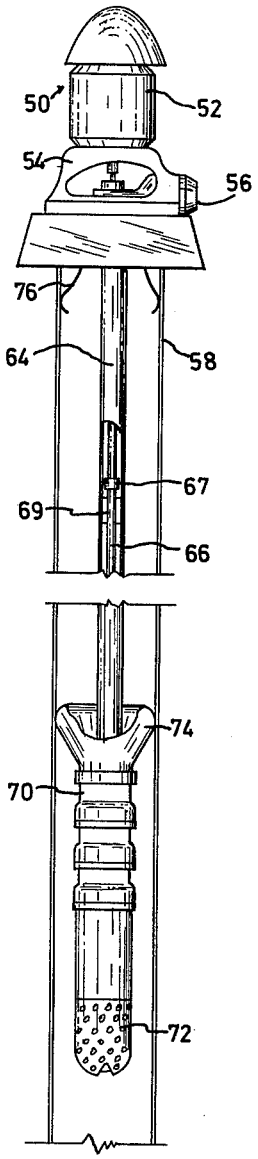
FIG. 4 is a view similar to FIGS. 1 and 2, showing a deep-well pump according to this invention.

Thus, said pump, generally identified by numeral 50, FIG. 4, comprises a motor 52, mounted on a wellhead 54 wherein there is also a discharge mouth 56 arranged to discharge therethrough water or other fluid from the bottom of the well. Said wellhead 54 is covering the wellhole 58 inside which there is a string formed by a sheath 64 which in turn supports said pump; said sheath covers a shaft 66 formed by lengths connected by couplings of the shaft 67. Said shaft is rotatively connected by means of bearings 69 and the entire assembly goes inside the well as deep as necessary, ending in a plurality of impelling bowls 70 and a suction end 72.

In lieu of a discharge tubing, a seal 76 is provided at the upper end of said well, in direct physical contact with the conduit from the wellhead to the discharge mouth 56; said seal 76 connecting said conduit directly to the well wall 58, in order to isolate said upper end of the well from the exterior and has as the only communication therefor the wellhead conduit and the discharge mouth 56.

Likewise, at the upper edge contiguous the uppermost bowls, another seal 74 has been provided, connecting directly the fluid outlet conduit of the last bowl to the wall 58 of said well, and therefore, the entire portion of the well from the top seal 76 to the lower seal 74, becomes enclosed and sealed, isolated from the rest of the wall and constitutes actually a discharge conduit for said fluid being extracted from the well.

Next, said fluid will pass from the bottom of the well, through the suction end 72, towards said bowls 70, and therefrom said fluid accumulates on said lower seal, so as to form a column of increasing height along the entire sealed portion the fluid reaches the top seal 76, wherein there is no other way for the fluid but the wellhead conduit and the discharge mouth, thus avoiding the need of employing discharge pipe strings.

Referring again to FIG. 3, it is seen that supporting means 43 have been shown in full lines; said means 43 can be rods, beams or any other means suitable for supporting the pump body 30 or bowls, as well as a motor 40. As can be seen, there are also two sealing elements 74'' and 76'', the structural nature of which allows the employment of the well 18'', when this latter is in good state, as the discharge pipe. In said FIG. 3, the discharge casing string has been shown in dotted lines, which means that said string is removed once the well is employed for the conduction of the fluid being pumped.

As will be obvious for those skilled in the art, the material from which both the top and the lower seals are made, preferably is a resilient material, in order for the same to bear resiliently against the walls of said well. The seals 74 and 76 are each a frusto-conical seal with the greater diameter end formed inwardly at its extremity to form a smoothed curved surface tangentially engaging the wall of the well. The lower seal is located with the less-diameter end downwardly, and the greater diameter end upwardly, bearing against the wall; and said top seal is contrary arranged, i.e., with its greater diameter end downwardly.

The manner in which said top seal is connected to said wellhead can broadly vary, and it is within the skill of the technicians to employ suitable connecting devices. Likewise, the manner in which the lower seal can be connected to the outlet of the uppermost bowl varies broadly; in both cases being only required that said connection be fluid-tight and strong enough to support the pressures incident on the seals during their use. Said pressures, as it will be obvious, will broaden the resilient material in order to bear with greater force against the wall; with said bearing force being directly dependent of the pressure of the fluid flow from the well, and of the height of the fluid column; therefore, when in a non-stressed condition said seal provides a suitable elastic bearing, an efficient sealing action could be obtained to any normal pressure during the well's operation.

It will be obvious that the details of installation, shape and materials from which the seals are made, and other details can be different to those disclosed and depicted herein; it being only necessary that the discharge pipe string be dispensed with, and substituted by the well itself in order to be within the inventive teachings. Therefore, it is intended that all obvious changes are embraced by the following claims.

What is claimed is:

1. A pumping system for a deep-well having a wall including upper and lower ends, said system comprising:

driving means disposed adjacent the bottom of the well and having a lower suction inlet and an upper outlet for driving the fluid to be pumped from the bottom of the well to the surface;

actuating means for said driving means connected to a suitable power source and being suitably drivingly connected to said driving means;

a first sealing means located at the upper end of said wall to hermetically seal said upper end of the wall and to form a discharge outlet of said well;

a second sealing means adjacent the bottom of the well for sealing said driving means to the wall of the well between the lower suction inlet and the upper outlet of the driving means;

said first and second sealing means providing a sealed wall section between the first and second sealing means forming the only conduit in the well from the upper outlet of the driving means to the discharge outlet of the well for the fluid being pumped; and said second sealing means including a hollow frusto-conical seal portion with the greater diameter end of the seal portion extending upward and formed inwardly to form a smooth curved surface tangentially engaging the wall of the well, the lower smaller diameter end of the seal portion being secured to the driving means.

2. A pumping system for a deep-well having a wall including upper and lower ends, said system comprising:

driving means disposed adjacent the bottom of the well and having a lower suction inlet and an upper outlet for driving the fluid to be pumped from the bottom of the well to the surface;

actuating means for said driving means connected to a suitable power source and being suitably drivingly connected to said driving means;

a first sealing means located at the upper end of said wall to hermetically seal said upper end of the wall and to form a discharge outlet of said well;

a second sealing means adjacent the bottom of the well for sealing said driving means to the wall of the well between the lower suction inlets and the upper outlet of the driving means;

said first and second sealing means providing a sealed wall section between the first and second sealing means forming the only conduit in the well from the upper outlet of the driving means to the discharge outlet of the well for the fluid being pumped;

a wellhead having a discharge conduit;

said first sealing means including a hollow frusto-conical seal portion with the greater diameter end of the seal portion extending downward and bearing resiliently against the wall and with the smaller diameter end of the seal portion extending upward and secured to the discharge conduit of the wellhead; and said greater diameter end of the seal portion being formed inwardly to form a smooth curved surface tangentially engaging the wall of the well.

3. A pumping system for a deep-well having a wall including upper and lower ends, said system comprising:

driving means disposed adjacent the bottom of the well and having a lower suction inlet and upper outlet for driving the fluid to be pumped for the bottom of the well to the surface:

actuating means for said driving means connected to a suitable power source and being suitable drivingly connected to said driving means;

a first sealing means located at the upper end of said wall to hermetically seal said upper end of the wall and to form a discharge outlet of said well;

a second sealing means adjacent the bottom of the well for sealing said driving means to the wall of the well between the lower suction inlets and the upper outlet of the driving means;

said first and second sealing means providing a sealed wall section between the first and second sealing means forming the only conduit in the well from the upper outlet of the driving means to the discharge outlet of the well for the fluid being pumped;

said second sealing means including a first hollow frusto-conical seal portion with its greater diameter end of the first seal portion extending upwardly and formed inwardly to form a smooth curved surface tangentially engaging the wall of the well, the lower smaller diameter end of the first seal portion being secured to the driving means;

a wellhead with a discharge conduit; and said first sealing means including a second hollow frusto-conical seal portion with the greater diameter end of the second seal portion extending downward and bearing resiliently against the wall and with the lesser diameter end of the second seal portion extending upward and secured to the discharge conduit of the wellhead, the greater diameter end of the second seal portion being formed inwardly to form a smooth curved surface tangentially engaging the wall of the well.

* * * * *